US005249313A

United States Patent [19]

Chang

[11] Patent Number: 5,249,313

[45] Date of Patent: Oct. 5, 1993

[54] CONTROL DEVICE FOR A PULL TYPE FLUSH TANK

[76] Inventor: Fong-Chyi Chang, 72, Ming Lie Street, Taichung, Taiwan

[21] Appl. No.: 834,851

[22] Filed: Feb. 3, 1992

[51] Int. Cl.[5] ..... E03D 1/14

[52] U.S. Cl. ..... 4/325

[58] Field of Search ..... 4/324, 325, 379–384, 4/415, 410–413, 414

[56] References Cited

U.S. PATENT DOCUMENTS 4,651,359 3/1987 Battle ..... 4/325
4,882,793 11/1989 Thompson ..... 4/324
5,191,661 3/1993 Chang ..... 4/324

FOREIGN PATENT DOCUMENTS 2077790 12/1981 United Kingdom ..... 4/324

*Primary Examiner*—Charles E. Phillips

[57] ABSTRACT

A control device including an outlet pipe disposed in a water tank, a valve disposed on top of the outlet pipe, a rod disposed above the valve and coupled to a knob which is disposed on the water tank, a pawl rotatably supported on top of the frame and coupled to the knob, a float slidably engaged on the rod and will be caught by the pawl when the float moves downward so that all of the water can be discharged, and the float will not be caught by the pawl when the knob is released right after the knob is pulled so that the float may move downward to close the valve.

10 Claims, 4 Drawing Sheets

CONTROL DEVICE FOR A PULL TYPE FLUSH TANK

BACKGROUND OF THE INVENTION

1. Field of the Invention

The present invention relates to a control device, and more particularly to a control device for a pull type flush tank.

2. Description of the Prior Art

Typical flush tanks include an outlet valve from which water may flow out for flushing purposes. Generally, water volume flowing out of the flush tank is predetermined and can not be adjusted so that the same amount of water will be discharged whenever the outlet valve is opened. This wastes water because, in some cases, the water volume required is less than the predetermined volume.

The present invention has arisen to mitigate and/or obviate the afore-described disadvantages of the conventional control devices for flush tanks.

SUMMARY OF THE INVENTION

The primary objective of the present invention is to provide a control device for pull type flush tanks in which the discharged water volume of the flush tank can be adjusted.

In accordance with one aspect of the invention, there is provided a control device for a water tank comprising an outlet pipe disposed in the water tank and including an upper end communicated with the water tank, a valve disposed on the upper end of the outlet pipe for opening and closing the outlet pipe, a knob disposed on an upper portion of the water tank and reachable from outside of the water tank, a rod including a lower end fixed to the valve and an upper end coupled to the knob so that the valve can be pulled open by the knob and so that water contained within the water tank may flow out via the outlet pipe, a stop disposed on the rod, a frame disposed in the water tank and disposed above the outlet pipe and including an upper end having an axle disposed thereon, the rod extending upward beyond the upper end of the frame, a pawl having a middle portion rotatably supported on the axle and including a hook formed on a first end thereof and including a second end coupled to the knob so that the pawl can be caused to rotate about the axle by the knob; a float slidably engaged on the rod and movable upward and downward along the rod, the stop being located below the float, a catch laterally extended from the float; the hook of the pawl being caused to move to a position located below the catch of the float when the second end of the pawl is elevated; whereby, the float is lowered when the water discharges out through the outlet pipe, the catch of the float is caught by the hook of the pawl when the float moves downward and when the knob is pulled for a short period of time, so that the valve will move downward to close the outlet pipe after almost all of the water contained within the water tank has been discharged, and the catch of the float will not be caught by the hook of the pawl when the knob is released right after pulling operation thereof so that the float may move downward along the rod to engage with the stop and so that the valve can be pushed downward to close the outlet pipe before all of the water contained within the water tank is fully discharged.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
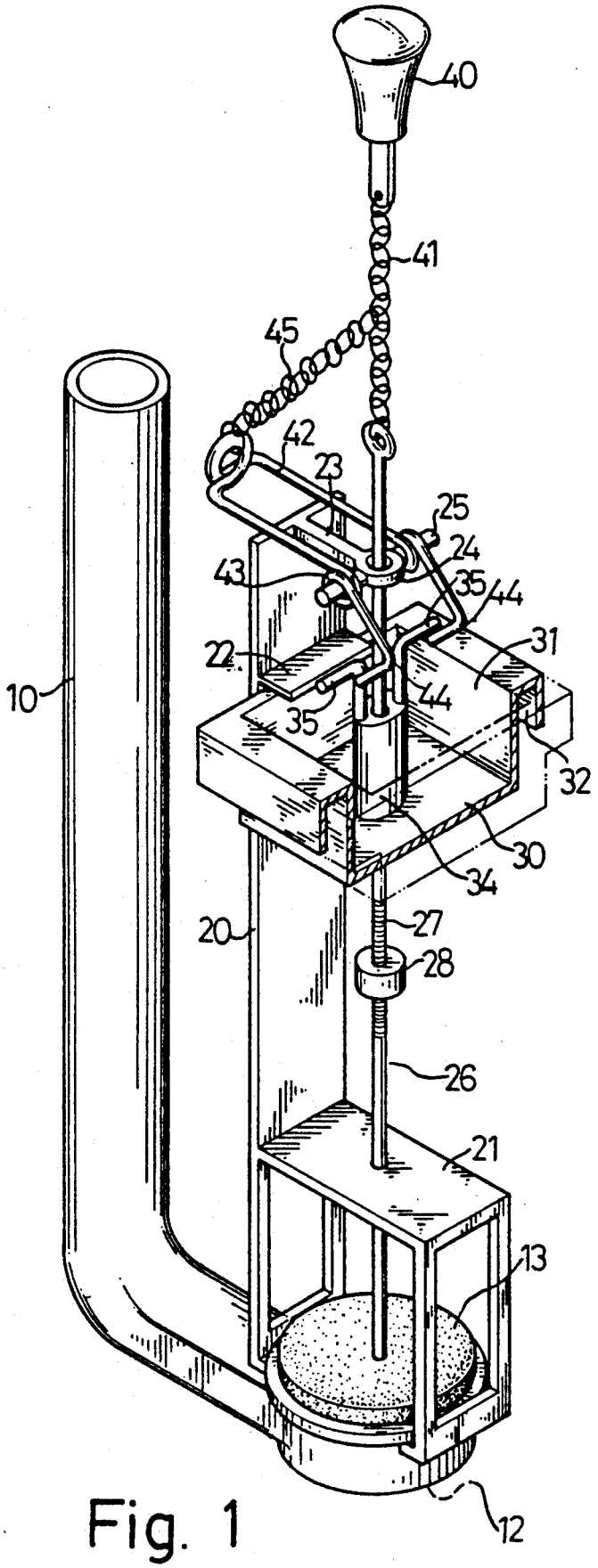
FIG. 1 is a perspective view of a control device for a pull type flush tank in accordance with the present invention.

Referring to the drawings and initially to FIGS. 1 and 2, a control device in accordance with the present invention comprises generally a tube 10 vertically disposed is a water tank or a flush tank 11, an outlet pipe 12 disposed below the flush tank 11 and having an upper end communicated with the water tank 11, the tube 10 has a lower end communicated with the outlet pipe 12 and has an open upper end from which excessive water may flow out of the flush tank via the outlet pipe 12. A valve 13 is disposed on the upper portion of the outlet pipe 12 for opening and closing the outlet pipe 12. The valve 13 is made of light weight materials and preferably has a hollow interior so that the valve 13 will be buoyed upwards by the water contained within the flush tank 11 when the valve 13 is pulled upward and when the water contained within the water tank 11 flows out of the water tank 11 via the outlet pipe 12.

A frame 20 is disposed above the outlet pipe 12 and includes a board 21 horizontally disposed above the valve 13, and a flange 22 and an extension 23 laterally extended from the upper end thereof. A ring 24 is formed in the free end portion of the extension 23 and a pair of axles 25 are oppositely formed on the ring 24. The axles 25 are preferably arranged perpendicular to the extension 23. A rod 26 has a lower end extended through the board 21 and fixed to the valve 13 and has an upper end extended upward through the ring 24. An outer thread 27 is formed in the middle portion of the rod 26, and a stop 28 is threadedly engaged with the outer thread 27 so that the estop 28 can be adjusted upward and downward along the rod 26.

A float 30 is slidably engaged on the rod 26 and located above the stop 28 and can be guided to move up and down along the rod 26. The float 30 has one side slidably engaged with the frame 20 so that the float 30 can be prevented from rotating about the rod 26. The float 30 is preferably made of light weight materials, such as plastic material so that the float 30 can be buoyed upward by the water contained within the water tank 11. The flange 22 limits the upward movement of the float 30. The float 30 includes a first chamber 31 formed in the middle portion and two second chambers 32 oppositely formed therein. The first chamber 31 opens upward so that water can be contained within the first chamber 31, and the water contained within the first chamber 31 can be used as a weight for facilitating the downward movement of the float 30.

The second chambers 32 open downward so that gas can be contained within the second chambers 32 in order to increase the buoyant capability of the float 30. A post 34 is disposed in the middle portion of the first chamber 31 of the float 30 and is preferably slidably engaged on the rod 26. A pair of inverted L-shaped catches 35 are oppositely disposed above the post 34.

A knob 40 is disposed in the upper portion of the water tank 11 and has a lower end coupled to the upper end of the rod 26 by a cable or chain 41. The knob 40 is reachable from outside of the water tank 11 so that the valve 13 can be pulled open by the knob 40. A pawl 42 includes two legs each having a middle portion 43 rotatably engaged on the respective axle 25 and each having a hook 44 formed on the first end thereof, the second ends of the legs of the pawl 42 are fixed together and coupled to the middle portion of the chain 41 by another chain 45 so that the pawl 42 can be caused to rotate about the axles 25 by the know 40. It is to be noted that the chain 45 can also be coupled to the knob 40 instead of coupling to the chain 41.

Figure 2:
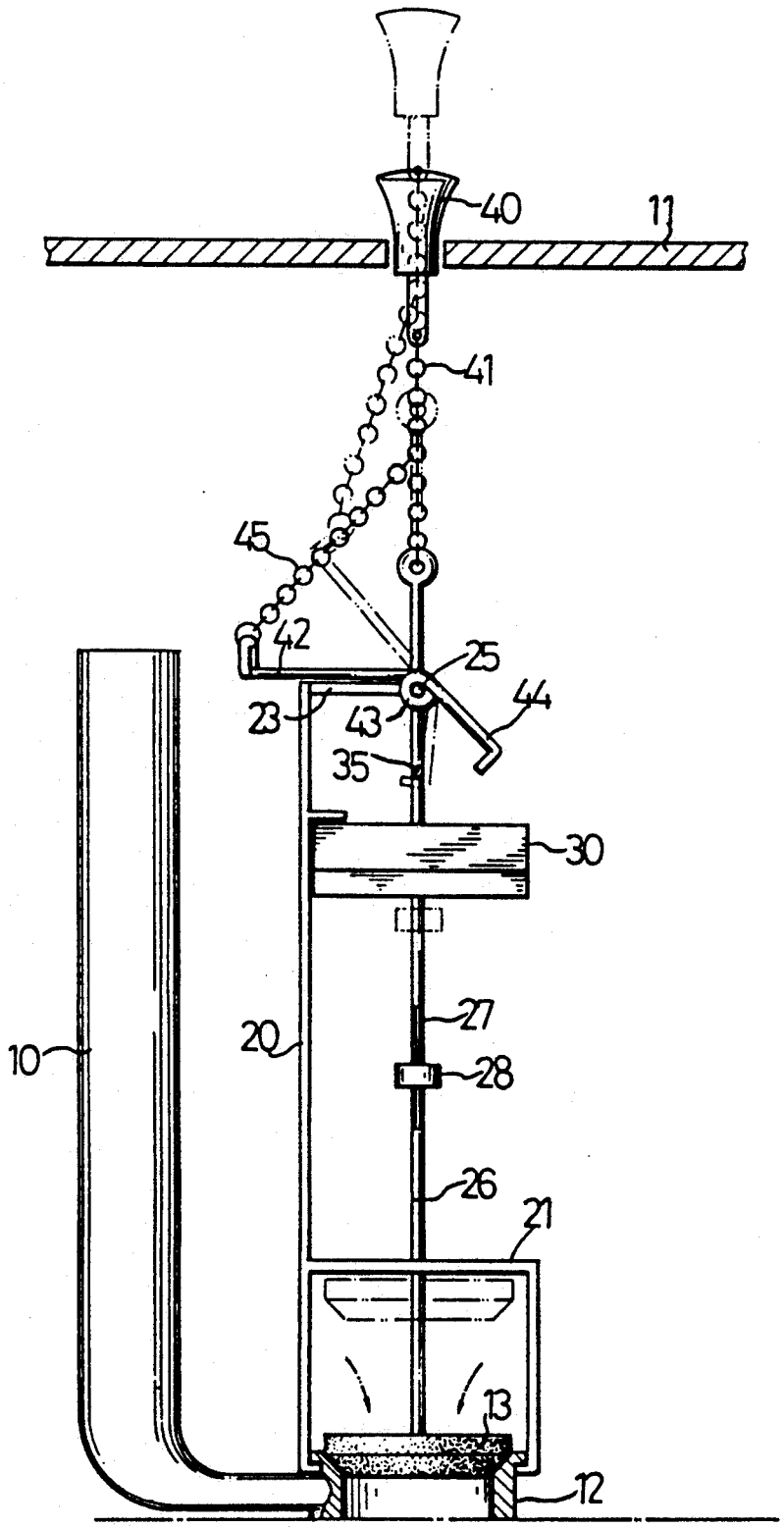
FIG. 2 is a side plane view illustrating the operations of the control device.

When the knob 40 is pulled upwards, as shown in FIG. 2, the pawl 42 can be caused to move from a first position, as shown in solid lines, to a second position, as shown in dotted lines, the hooks 44 of the pawl 42 can be caused to move to the position located below the catches 35 respectively so that the catches 35 can be caught by the hooks 44 and so that the float 30 can be retained in the upper position by the hooks 44. It is to be noted that the pawl 42 is arranged such that it will be maintained in the first position by gravity when the knob 40 is not pulled upward by the user.

Figure 3:
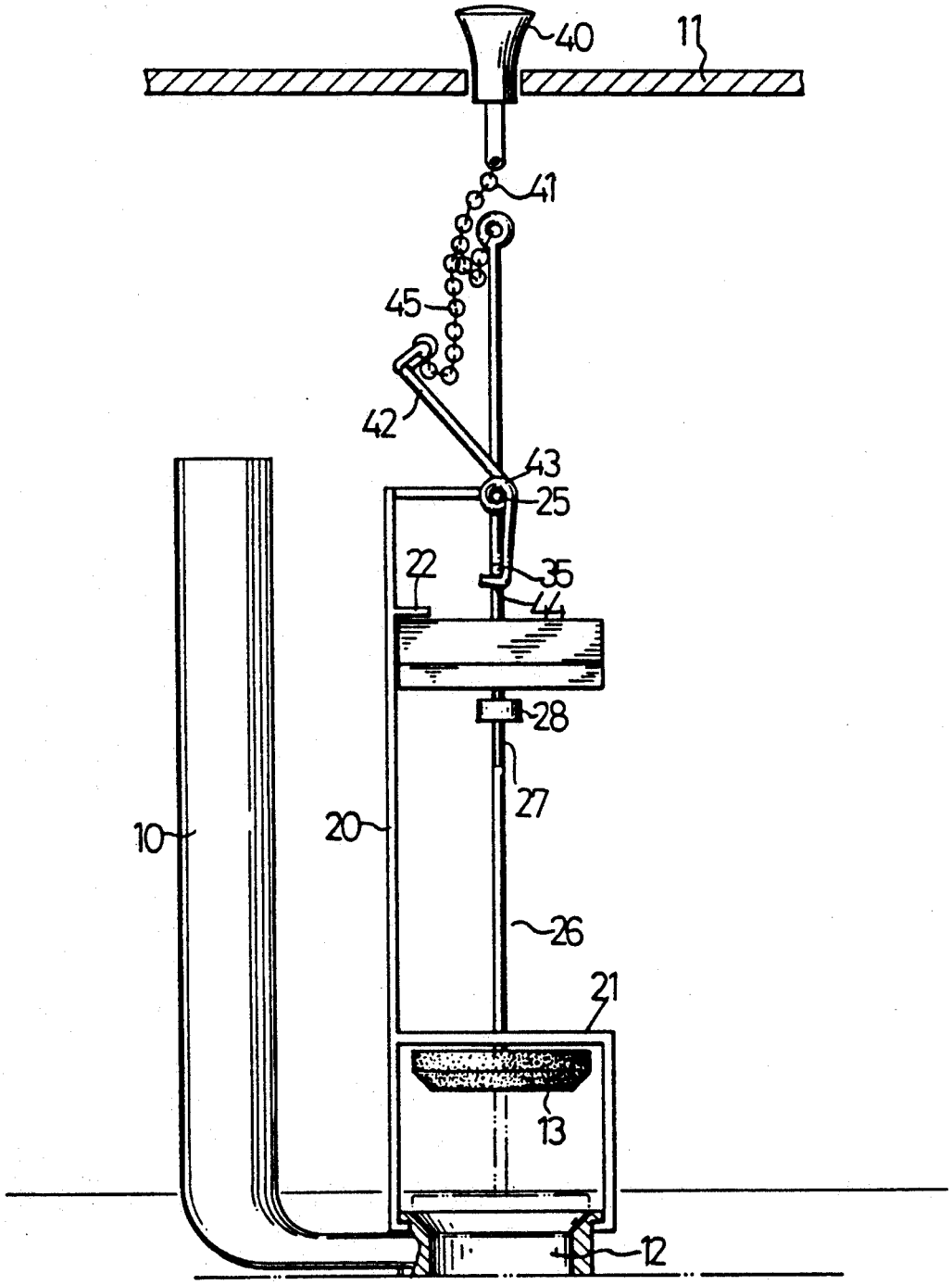
FIG. 3 is a side plane view similar to FIG. 2 for illustrating the operations of the control device, in which the water contained within the flush tank can be fully discharged.
Figure 4:
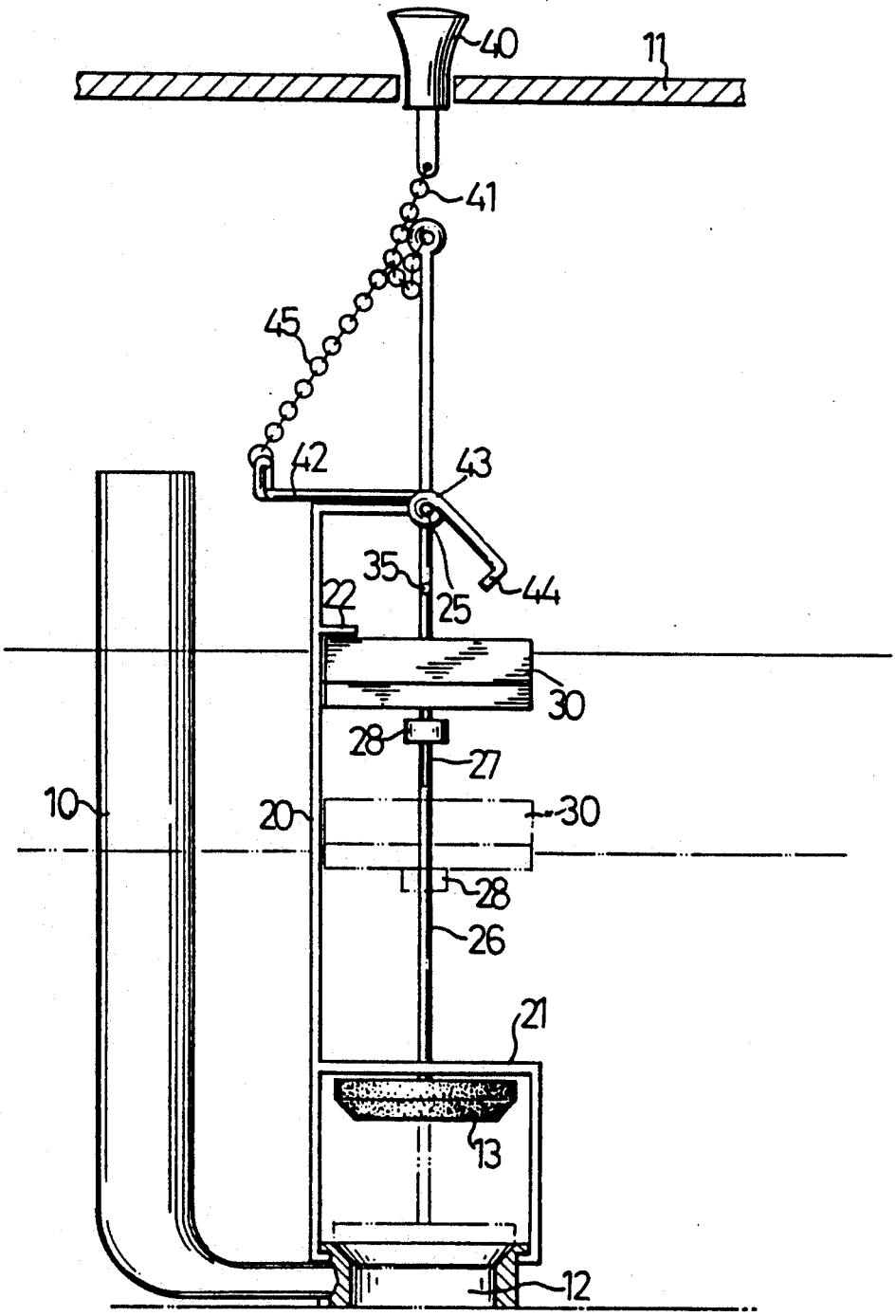
FIG. 4 is a side plane view similar to FIG. 3 for illustrating the operations of the control device, in which the water contained within the flush tank can be partly discharged.

In operation, as shown in FIG. 3, when it is required to discharge the water contained within the water tank, the knob 40 is pulled upward so that the valve 13 is pulled open and so that the water contained within the water tank 11 can flow out through the outlet pipe 12. The valve 13 is buoyed by the water contained within the water tank 11 so that the valve 13 can be maintained in the open position; simultaneously, the pawl 42 can be caused to rotate about the axles 25 and is rotatable from the first position, as shown in solid lines in FIG. 2, to the second position as shown in dotted lines in FIG. 2, so that the hooks 44 can be caused to move to the position located below the catches 35. When the knob 40 is maintained in the upward position for about three to five seconds, i.e., the knob 40 is still pulled upward by the user, the water level contained within the water tank 11 will be lowered and the float 30 will also be lowered such that the catches 35 will be caught by the hooks 44 and such that the float 30 will not move downward. The knob 40 can be released after the catches 35 are caught by the hooks 44. The valve 13 will move downward to close the outlet pipe 12 when almost all of the water contained within the water tank 11 has been discharged.

However, when it is required to discharge only part of the water contained within the water tank, the knob 40 is also pulled upward by the user, but the knob 40 should be released within about three seconds, preferably released right after the knob 40 is pulled upward and before the catches 35 are caught by the hooks 44, accordingly, the float 30 moves downward when the water level is lowered. The valve 13 will be depressed to close the outlet pipe 12 by the float 30 before all of the water contained within the water tank 11 has been discharged so that only part of the water contained within the water tank 11 can be discharged. When the stop 28 is adjusted upwards and downwards along the rod 26, the timing of the float 30 reaching the stop 28 can be adjusted such that the close operations of the valve 13 can be adjusted and such that the water volume flowing out of the water tank 11 can be adjusted.

Accordingly, the discharged water volume of the water tank controlled by the control device in accordance with the present invention can be adjusted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A control device for a water tank comprising an outlet pipe disposed in said water tank and including an upper end communicated with said water tank, a valve disposed on said upper end of said outlet pipe for opening and closing said outlet pipe, said device comprising, a knob disposed on an upper portion of said water tank and reachable from outside of said water tank, a rod including a lower end fixed to said value and an upper end coupled to said knob so that said valve can be pulled open by said knob and so that water contained within said water tank may flow out via said outlet pipe, a stop disposed on said rod, a frame disposed in said water tank and disposed above said outlet pipe and including a flange and an upper end having an axle disposed thereon, said rod extending upward beyond said upper end of said frame, a pawl having a middle portion rotatably supported on said axle and including a hook formed on a first end thereof and including a second end coupled to said knob so that said pawl will rotate about said axle when said knob is pulled; a float slidably engaged on said rod and movable upward to a point where it contacts said flange and downward along said rod to a point where it contacts said stop, a catch laterally extended from said float; said hook of said pawl being caused to move to a position located below said catch of said float when said second end of said pawl is elevated; whereby, with enough water in said tank to force said float into contact with said flange, when said knob is pulled said valve will unseat and become buoyant in said water and said water will begin to discharge out through said outlet pipe, when said knob is held upwardly said catch of said float is caught by said hook of said pawl when said float begins to move downward with the water level and said valve will reseat after almost all of the water in said tank has drained out, when said knob is released after being pulled to unseat said valve, said catch of said float will not be caught by said hook of said pawl and said float will move downwardly along said rod to engage with said stop and force said valve downwardly to close said outlet pipe before all of the water contained within said water tank is fully discharged.

2. A control device according to claim 1, wherein said frame includes a board horizontally disposed above said valve and includes a ring formed on said upper end of said frame, said rod extends through said board and said ring of said frame so that said rod can be guided to move up and down.

3. A control device according to claim 1, wherein said float includes a first chamber formed therein, said first chamber opens upward so that water can be contained within said first chamber and can be used as a weight.

4. A control device according to claim 1, wherein said float includes two second chambers formed therein, said second chambers open downward so that gas can be contained within said second chamber in order to increase the buoyant capability of said float.

5. A control device according to claim 1, wherein said rod includes an outer thread formed in a middle portion thereof, said stop is threadedly engaged on said outer thread of said rod so that said stop can be adjusted up and down along said rod.

6. A control device for a water tank comprising an outlet pipe disposed in said water tank and including an upper end communicated with said water tank, a valve disposed on said upper end of said outlet pipe for opening and closing said outlet pipe, said device comprising a knob disposed on an upper portion of said water tank and reachable from outside of said water tank, a rod including a lower end fixed to said valve and an upper end coupled to said knob so that said valve can be pulled open by said knob and so that water contained within said water tank may flow out via said outlet pipe, a stop disposed on said rod, a frame disposed in said water tank and disposed above said outlet pipe and including a flange and an upper end having an extension laterally extended therefrom, said extension including a free end having a ring formed therein, said rod passing through said ring of said extension, a pair of axles oppositely disposed on said ring, a pawl including two legs each having a middle portion rotatably supported on a respective axle and each including a hook formed on a first end thereof and each including a second end, said second ends of said legs of said pawl being fixed together and coupled to said knob so that said pawl will rotate about said axles when said knob is pulled; a float slidably engaged on said rod and movable upward to a point where it contacts said flange and downward along said rod to a point where it contacts said stop, a pair of catches oppositely and laterally extended from said float; said hooks of said pawl being caused to move to a position located below said catches of said float respectively when said second ends of said legs of said pawl are elevated; whereby, with enough water in said tank to force said float into contact with said flange, when said knob is pulled said valve will unseat and become buoyant in said water and said water will begin to discharge out through said outlet pipe, when said knob is held upwardly said catches of said float are caught by said hooks of said pawl when said float begins to move downward with the water level and said valve will reseat after almost all of the water in said tank has drained out, when said knob is released after being pulled to unseat said valve, said catches of said float will not be caught by said hooks of said pawl and said float will move downwardly along said rod to engage with said stop and force said valve downwardly to close said outlet pipe before all of the water contained within said water tank is fully discharged.

7. A control device according to claim 6, wherein said frame includes a board horizontally disposed above said valve, said rod extends through said board of said frame so that said rod can further be guided to move up and down.

8. A control device according to claim 6, wherein said float includes a first chamber formed therein, said first chamber opens upward so that water can be contained within said first chamber and can be used as a weight.

9. A control device according to claim 6, wherein said float includes two second chambers formed therein, said second chambers open downward so that gas can be contained within said second chamber in order to increase the buoyant capability of said float.

10. A control device according to claim 6, wherein said rod includes an outer thread formed in a middle portion thereof, said stop is threadedly engaged on said outer thread of said rod so that said stop can be adjusted up and down along said rod.

* * * * *